US009940806B2

(12) United States Patent
Al-Farra et al.

(10) Patent No.: US 9,940,806 B2
(45) Date of Patent: Apr. 10, 2018

(54) FIRE DETECTION

(71) Applicant: Xtralis Technologies Ltd, Nassau, NP (BS)

(72) Inventors: Tawfeeq Gehad Al-Farra, East Bentleigh (AU); Alasdair James Williamson, Worthing (GB); John Vythoulkas, Brunswick (AU); Giuseppe Leslie Fiusco, Glen Iris (AU); Ghassan Habelrih, Montreal (CA); Rajiv Singh, Glen Waverley (AU)

(73) Assignee: Garrett Thermal Systems Limited, Berkshire (GB)

( * ) Notice: Subject to any disclaimer, the term of this patent is extended or adjusted under 35 U.S.C. 154(b) by 0 days.

(21) Appl. No.: 15/201,042

(22) Filed: Jul. 1, 2016

(65) Prior Publication Data

US 2016/0314669 A1 Oct. 27, 2016

Related U.S. Application Data

(62) Division of application No. 14/647,752, filed as application No. PCT/AU2013/001370 on Nov. 26, 2013, now Pat. No. 9,384,643.

(30) Foreign Application Priority Data

Nov. 27, 2012 (AU) ..... 2012905188

(51) Int. Cl.
*G08B 21/00* (2006.01)
*G08B 17/12* (2006.01)
(Continued)

(52) U.S. Cl.
CPC ..... *G08B 17/12* (2013.01); *G08B 17/02* (2013.01); *G08B 17/10* (2013.01); *G08B 25/002* (2013.01);
(Continued)

(58) Field of Classification Search
CPC ..... G08B 17/10; G08B 17/12
(Continued)

(56) References Cited

U.S. PATENT DOCUMENTS 4,608,556 A 8/1986 Cole
5,053,754 A 10/1991 Wong
(Continued)

FOREIGN PATENT DOCUMENTS

EP 1638062 3/2006
TW M435681 8/2012
WO WO-2014082122 6/2014

OTHER PUBLICATIONS

"U.S. Appl. No. 14/647,752, Notice of Allowance dated Mar. 4, 2016", 14 pgs.
(Continued)

*Primary Examiner* — Tai T Nguyen
(74) *Attorney, Agent, or Firm* — Schwegman Lundberg & Woessner, P.A.

(57) ABSTRACT

A particle detection system including a particle detector in fluid communication with at least two sample inlets for receiving a sample flow from a monitored region. The particle detector includes detection means for detecting the level of particles within the sample flow and outputting a first signal indicative of the level of particles within the sample flow. A flow sensor is located downstream of the sample inlets for measuring the flow rate of the sample flow and outputting a second signal indicative of the flow rate of the sample flow. At least a first sample inlet is normally open to the monitored region for receiving at least part of the sample flow. At least a second sample inlet is normally closed to the monitored region but is openable to the monitored region in response to a change in environmental conditions in the monitored region. The particle detection system further includes processing means adapted for
(Continued)

receiving the first and second signals and comparing the first signal to a predetermined threshold level and comparing the second signal to a predetermined threshold flow rate, and generating an output signal based on the respective comparisons of the first and second signals. A method of particle detection is also described.

4 Claims, 2 Drawing Sheets

(51) Int. Cl.

| | |
|---|---|
| ***G08B 17/10*** | (2006.01) |
| ***G08B 29/18*** | (2006.01) |
| ***G08B 17/02*** | (2006.01) |
| ***G08B 25/00*** | (2006.01) |
| *G08B 29/04* | (2006.01) |
| *G08B 17/00* | (2006.01) |

(52) U.S. Cl.
CPC ..... *G08B 29/185* (2013.01); *G08B 17/00* (2013.01); *G08B 29/043* (2013.01)

(58) Field of Classification Search
USPC ..... 340/606, 628, 629, 630, 515
See application file for complete search history.

(56) References Cited

U.S. PATENT DOCUMENTS

| | | | | |
|---|---|---|---|---|
| 5,295,505 | A | 3/1994 | Polaschegg et al. | |
| 5,477,218 | A | 12/1995 | Manmoto et al. | |
| 8,118,918 | B2 * | 2/2012 | Knox | B01D 46/0012 55/418 |
| 8,224,621 | B2 * | 7/2012 | Ajay | G01F 1/667 702/175 |
| 8,412,481 | B2 | 4/2013 | Knox | |
| 9,384,643 | B2 | 7/2016 | Al-Farra et al. | |
| 2010/0194575 | A1 | 8/2010 | Rodriguez | |
| 2015/0310717 | A1 | 10/2015 | Al-Farra et al. | |

OTHER PUBLICATIONS

"U.S. Appl. No. 14/647,752, Preliminary Amendment filed May 27, 2015", 8 pgs.
"International Application No. PCT/AU2013/001370, International Search Report and Written Opinion dated Jan. 21, 2014", (Jan. 21, 2014), 14 pgs.
"Taiwanese Application Serial No. 102142973, Office Action dated May 14, 2017", (English Translation), 1 pg.

* cited by examiner

FIRE DETECTION

PRIORITY CLAIM TO RELATED APPLICATIONS

This application is a divisional of U.S. application Ser. No. 14/647,752, filed on 27 May 2015, now U.S. Pat. No. 9,384,643, which application is a U.S. national stage application filed under 35 U.S.C. § 371 from International Application Serial No. PCT/AU2013/001370, which was filed 26 Nov. 2013, and published as WO 2014/082122 on Jun. 5, 2014, and which claims priority to Australia Application No. 2012905188, filed Nov. 27, 2012, which applications and publication are incorporated by reference as if reproduced herein and made a part hereof in their entirety, and the benefit of priority of each of which is claimed herein.

FIELD OF THE INVENTION

The present invention relates to particle detection systems and in particular to aspirated smoke detection systems. However, the invention is not limited to this particular application and other types of sensing systems for detecting particles in an air volume are included within the scope of the present invention.

BACKGROUND OF THE INVENTION

Pollution monitoring, and fire protection and suppressant systems may operate by detecting the presence of smoke and other airborne pollutants. Upon a threshold level of particles being detected, an alarm or other signal may be activated and operation of a fire suppressant system and/or manual intervention may be initiated.

Air sampling pollution monitoring equipment in the form of aspirated particle detection systems may incorporate a sampling pipe network consisting of one or more sampling pipes with one or more sampling holes, or inlets, installed at positions where smoke or pre-fire emissions may be collected from a region or environment being monitored, which is ordinarily external to the sampling pipe network. Typical configurations for aspirated particle detection systems are shown in FIGS. 1 and 2 in the form of aspirated smoke detection systems 10 and 20, respectively. Air is drawn in through the sampling holes 14, 24 and subsequently along the pipe or pipe network 12, 22 by means of an aspirator or fan (not shown) and is directed through a detector 16 at a remote location. Sampling points in the form of the sampling inlets 14, 24 are located at regions where particle detection is required. These regions are typically distant from the actual detector. Although there are a number of different types of particle detectors which may be used as the detector in a system as outlined above, one particularly suitable form of detector for use in such a system is an optical scatter detector, which is able to provide suitable sensitivity at reasonable cost. An example of such a device is a VESDA® LaserPlus™ smoke detector as sold by the applicant.

Optical scatter detectors operate on the principle that smoke particles or other airborne pollutants of small size, when introduced into a detection chamber and subjected to a high intensity light beam, will cause light to scatter. A light detector senses the scattered light. The greater the amount of particles within the sample introduced into the detector chamber the greater will be the amount of light scatter. The scatter detector detects the amount of scattered light and hence is able to provide an output signal indicative of the amount of smoke particles or other pollutant particles within the sample flow.

When aspirated particle detector systems are installed in environments that are subject to varying environmental conditions it would be beneficial to be able to not only detect the level of pollutants or smoke particles in the environment being monitored, but also to be able to monitor the level of heat in the environment, irrespective of the level of particles. It would be particularly beneficial to be able to monitor both the level of particles and heat in the environment since a high level of each in combination is generally indicative of fire.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

The present invention has arisen from the observation that the deliberate introduction of a flow fault to an aspirated particle detector system can serve the same purpose as a heat detector.

The present invention provides a particle detection system including:

a particle detector in fluid communication with at least two sample inlets for receiving a sample flow from a monitored region, the particle detector including detection means for detecting the level of particles within the sample flow and outputting a first signal indicative of the level of particles within the sample flow;

a flow sensor located downstream of the sample inlets for measuring the flow rate of the sample flow and outputting a second signal indicative of the flow rate of the sample flow;

wherein at least a first sample inlet is normally open to the monitored region for receiving at least part of the sample flow; and at least a second sample inlet is normally closed to the monitored region but is openable to the monitored region in response to a change in environmental conditions in the monitored region;

the particle detection system further including processing means adapted for receiving the first and second signals and comparing the first signal to a predetermined threshold level and comparing the second signal to a predetermined threshold flow rate, and generating an output signal based on the respective comparisons of the first and second signals.

In a particularly preferred embodiment, the second sample inlet is a heat activated sampling point. Accordingly, the second sample inlet is normally closed to the monitored region and in the event that high heat, generally at the level associated with a fire, is present in the monitored region, the second sample inlet is configured to open and admit additional flow from the monitored region towards the flow sensor.

Advantageously, a plurality of sample inlets are provided that are normally open to the monitored region. The plurality of sample inlets are preferably provided as part of a sampling pipe network that is in fluid communication with the particle detector. One or more flow sensors may be provided in the particle detection system downstream of one or more of the sample inlets.

Each of the sample inlets has a cross-sectional area that is open or openable to the monitored region. Preferably the at least one sample inlet that is responsive to heat is provided with a cross-sectional area that is larger than that of the sample inlets that are normally open to the monitored region. Alternatively, all sample inlets may have the same cross-sectional area and the ratio of heat activated sample inlets to the normally open sample inlets is increased. As a result, in the event that a high heat condition occurs in the monitored region, the at least one heat activated sample inlet is activated and becomes open to the monitored region and due to its larger size, and/or the higher ratio of heat activated sample inlets, causes an increase of flow to the flow sensor. The increase in flow is detected by the flow sensor as being above a threshold level. If smoke is also detected by the particle detector an alarm is activated signalling possible fire.

In some embodiments, the threshold flow rate may instead be a threshold flow range including an upper threshold flow rate and a lower threshold flow rate. In this instance, if flow to the flow sensor exceeds the upper threshold flow rate this could be indicative of a heat event or sampling pipe breakage, as described above. If flow to the flow sensor decreases to below the lower threshold flow rate this could be indicative of a blockage in a sampling pipe and/or one or more sampling inlets.

The invention also provides, a method of particle detection including;

analysing an air sample from an air volume being monitored and determining a level of first particles in the air sample;

analysing a flow rate of the air sample from the air volume and determining a flow rate of the air sample;

processing the level of particles in the air sample in accordance with at least one first alarm criterion and processing the flow rate of the air sample in accordance with at least one second alarm criterion; and performing an action.

The step of performing an action can include sending a signal, for example, a signal indicative of an alarm or fault condition, a change in an alarm or fault condition, a pre-alarm or pre-fault condition or other signal, a signal indicative of either or both of the level of particles and flow rate.

The first alarm criterion is preferably a threshold particle level and is indicative of a possible smoke event. The second alarm criterion is preferably a threshold flow rate and is indicative of a possible heat event or flow fault.

The air sample and the flow rate can be analysed simultaneously, consecutively or alternately.

BRIEF DESCRIPTION OF THE DRAWINGS

The invention will now be described, by way of example only, with reference to the accompanying drawings in which.

DESCRIPTION OF PREFERRED EMBODIMENTS

Figure 1:
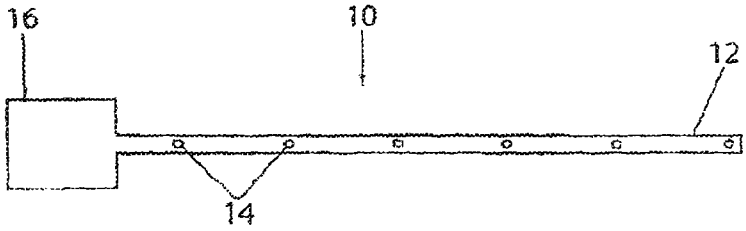
FIG. 1 is a schematic representation of a conventional aspirated particle detection system.

An aspirated particle detection system 10 is shown in FIG. 1, and comprises a pipe 12 having a number of sampling inlets shown as points 14, and a detector 16.

The detector may be any type of particle detector, comprising for example a particle counting type system such as a VESDA® LaserPlus™ smoke detector sold by the applicant. Typically the detector 16 comprises a detection chamber, indicator means and an aspirator for drawing sampled air through the pipe into the detection chamber.

In operation, each sampling point 14 may be placed in a location where smoke detection is required. In this way a sampling point 14 acts to detect smoke in a region.

Figure 2:
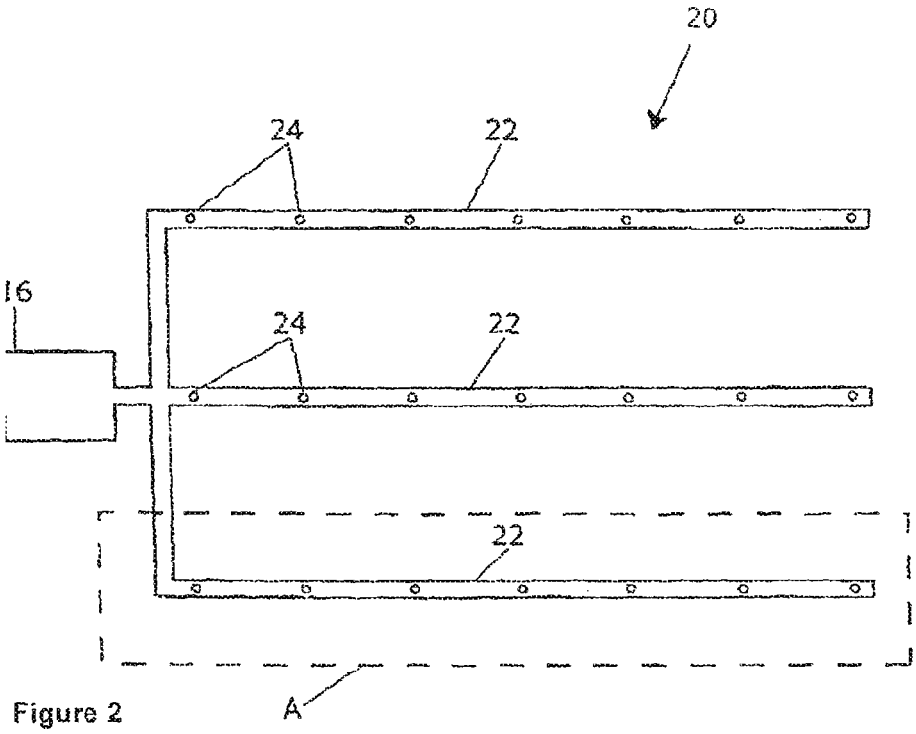
FIG. 2 is a schematic representation of an alternate form of conventional aspirated particle detection system.

A second embodiment of a particle detection system is shown in FIG. 2, where a pipe network 20 comprising a number of pipes 22 with sampling points 24 is shown. A similar detector to the detector 16 shown in FIG. 1 may be used. One pipe 22 may consist of a branch, such as branch A in FIG. 2.

In the above systems, air is drawn through sample points 14, 24 and into the pipe 12, 22. The pipe 12 (or 24), will have a number of sampling points 14, (or 24), and therefore air will be drawn through all sampling points within a single pipe when the sampling points are open.

Typically there are 2 commonly used styles of sampling points in aspirated particle detectors. The first type of sample point is a simple hole drilled in a sampling pipe 12. Typically the hole may be of 3 mm diameter, while a pipe may be of 25 mm outer diameter; though these figures will vary from design-to-design and from region to-region. The second style of sampling point is typically in the form of a nozzle connected to the sample pipe 12 by a length of relatively narrow flexible hose.

Figure 3:
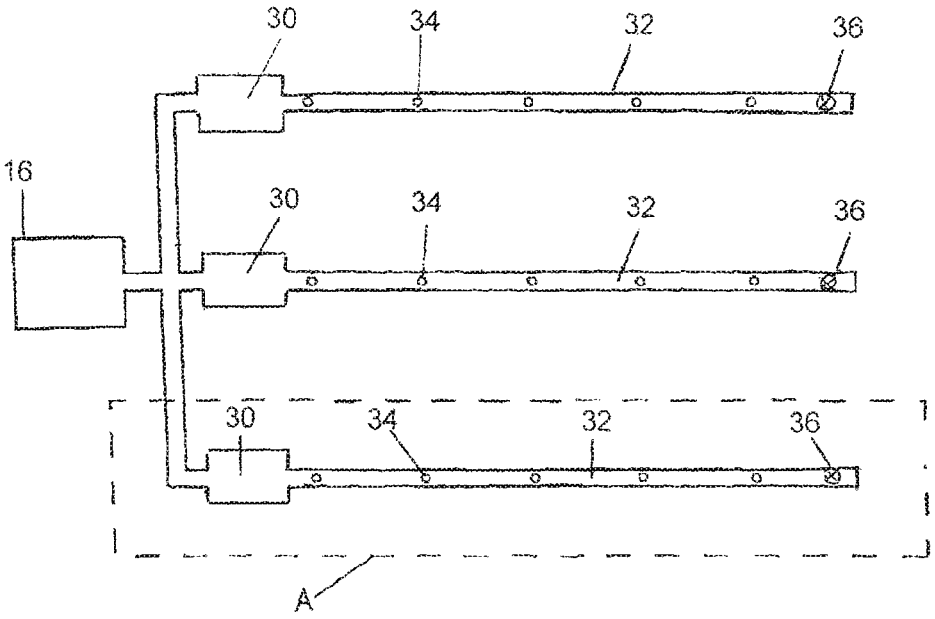
FIG. 3 is a schematic representation of an aspirated particle detection system according to an embodiment of the present invention.

Referring to the embodiment of the invention illustrated in FIG. 3, a flow sensor 30 is provided downstream of the sampling points 34, either before or after the detector 16. Sampling points 34 are the same as sampling points 14, 24 described above and under normal ambient conditions are open to the monitored region.

In the embodiment illustrated a flow sensor 30 is provided in each pipe 32 immediately upstream of the detector 16. The flow sensor 30 may take a number of forms. In one embodiment an ultrasonic flow meter is used. The ultrasonic flow meter comprises two transducers spaced apart by a known distance, exposed to but not necessarily in the air flow into the sampling point. The flow is detected by measuring time of flight of an ultrasound waveform or signal transmitted from one transducer to another. The use of ultrasonic transducers allows for accurate measurement of airflow, while providing low resistance to air flow, as the transducers do not need to project into the airstream. Each flow sensor outputs a reading, for example in liters of air per minute, to a processor (not shown). Thermal flow sensors such as the resistance temperature detectors employed in the VESDA® LaserPlus™ smoke detector may also be used in the present invention.

Heat activated sampling points 36 are provided in one or more of the pipes 32. In this embodiment, one heat activated sampling point is provided in each pipe 32 but there may of course be more than one heat activated sampling point in each pipe 32. Sampling points 36 are shown located towards an end of pipe 32 but they may be positioned anywhere along the pipe 32 depending on the region to be monitored. The heat activated sampling points 36 may have the same cross-sectional area in communication with the monitored region as sampling points 34 although it is preferred that sampling points 36 either have a larger cross-sectional area or that there is a higher ratio of heat activated sampling points 36 to sampling points 34. This allows a larger increase in flow rate to be introduced to the sampling pipe 32 in the event the sampling points 36 are activated.

In preferred embodiments of the invention heat activated sampling points 36 are used in the sampling pipe network in conjunction with conventional sampling points 34 described above. The heat activated sampling points 36 comprise a housing (not illustrated) that allows the flow of air from a monitored region into a sampling pipe and to detector 16. The housing is blocked by a plug that is either formed from or retained by a substance with a predetermined melting point such as a sealant or wax. When the temperature in the monitored region reaches the predetermined melting point of the wax, the plug either melts or falls away thereby opening the housing and allowing air into the sampling pipe from the monitored region. The increase in flow is measured by the flow sensor which effectively detects a "flow fault" and sends a signal to the processor.

In a preferred embodiment of the invention the detector 16 includes detection means for detecting the level of particles within the sample flow and outputting a first signal indicative of the level of particles within the sample flow to a processor (not shown). Similarly the flow sensor 30 measures the flow rate of the sample flow and outputs a second signal indicative of the flow rate of the sample flow to the processor.

The processor receives the first and second signals and compares the first signal to a predetermined threshold level and compares the second signal to a predetermined threshold flow rate. As a result of the respective comparison the processor generates an output signal.

There are four output signals or "alarm states" that may be generated by the processor:

| | No smoke | Smoke |
|---|---|---|
| No heat | Particles detected in air sample below threshold level<br>Flow rate of air sample below threshold level | Particles detected in air sample above threshold level<br>Flow rate of air sample below threshold level |
| Heat | Particles detected in air sample below threshold level<br>Flow rate of air sample above threshold level | Particles detected in air sample above threshold level<br>Flow rate of air sample above threshold level |

At the first alarm level particles detected in air sample are below a threshold level and the flow rate of air sample is below a threshold level. This indicates that there is no smoke or heat, i.e. no fire, and no alarm is raised.

At the second alarm level, particles detected in the air sample are below a threshold level and the flow rate of the air sample is above a threshold level. This indicates that there is heat or a flow fault, such as a sampling pipe breakage, in the monitored region but no smoke. A signal is generated to further investigate the monitored region and to rectify the flow fault. This may include a visual inspection for example.

At the third alarm level particles detected in the air sample are above a threshold level and the flow rate of the air sample is below a threshold level. This indicates that there may be smoke present but no heat. In this instance a signal is generated to further investigate the monitored region. The detector may include a secondary particle detection stage that can be used to further verify the type and/or level of particles in the sample flow.

At the fourth alarm level particles detected in the air sample are above a threshold level and the flow rate of the air sample is above a threshold level. This indicates that there is smoke and either heat or a flow fault present in the monitored region. An alarm is activated to urgently investigate the monitored region, fire authorities may be notified, and fire suppression devices may be activated.

In certain embodiments a lower threshold flow rate may also be monitored. In this instance, the measured flow rate is compared to a threshold flow range having an upper threshold flow rate and a lower threshold flow rate. If flow to the flow sensor exceeds the upper threshold flow rate this could be indicative of a heat event or sampling pipe breakage, as described above. If flow to the flow sensor decreases to below the lower threshold flow rate this could be indicative of a blockage in a sampling pipe and/or one or more sampling inlets. If the measured flow rate is below the lower threshold flow rate a signal is generated indicating a flow fault, potentially due to pipe and/or inlet blockage, and action may be taken to rectify the flow fault.

It will be appreciated that the use of heat activated sampling points in conjunction with conventional sampling points of an aspirated smoke detector allows the present invention to be used in environments where it is desirable to distinctly monitor heat events, smoke events, and heat and smoke events.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A method of particle detection including:

analysing an air sample from an air volume being monitored and determining a level of first particles in the air sample;

analysing a flow rate of the air sample from the air volume and determining a flow rate of the air sample;

processing the level of particles in the air sample in accordance with at least one first alarm criterion and processing the flow rate of the air sample in accordance with at least one second alarm criterion, wherein the second alarm criterion is a threshold flow rate and is indicative of a possible heat event; and performing an action.

2. The method of particle detection according to claim 1, wherein the step of performing an action includes sending a signal, a signal indicative of an alarm or fault condition, a change in an alarm or fault condition, a pre-alarm or pre-fault condition or other signal, a signal indicative of either or both of the level of particles and flow rate.

3. The method of particle detection according to claim 1, wherein the first alarm criterion is a threshold particle level and is indicative of a possible smoke event.

4. The method of particle detection according to claim 1, wherein the air sample and the flow rate can be analysed simultaneously, consecutively or alternately.

* * * * *